US007892305B2

(12) United States Patent
Hyun et al.

(10) Patent No.: US 7,892,305 B2
(45) **Date of Patent: *Feb. 22, 2011**

(54) DUST COLLECTING DEVICE FOR VACUUM CLEANER

(75) Inventors: Kie Tak Hyun, Changwon-si (KR); Young Bok Son, Changwon-si (KR); Kyeong Seon Jeong, Changwon-si (KR); Il Joong Kim, Hapchon-gun (KR)

(73) Assignee: LG Electronics Inc., Seoul (KR)

( * ) Notice: Subject to any disclaimer, the term of this patent is extended or adjusted under 35 U.S.C. 154(b) by 29 days.

This patent is subject to a terminal disclaimer.

(21) Appl. No.: 11/990,400

(22) PCT Filed: Aug. 17, 2005

(86) PCT No.: PCT/KR2005/002688

§ 371 (c)(1),
(2), (4) Date: Mar. 27, 2009

(87) PCT Pub. No.: WO2007/021043

PCT Pub. Date: Feb. 22, 2007

(65) Prior Publication Data

US 2009/0205298 A1 Aug. 20, 2009

(51) Int. Cl.
*B01D 45/00* (2006.01)

(52) U.S. Cl. ..... 55/343; 55/345; 55/346; 55/424; 55/428; 55/429; 55/DIG. 3; 15/352; 15/353; 96/414; 96/415; 96/416

(58) Field of Classification Search ..... 55/343, 55/345, 346, 424, 428, 447, 429, DIG. 3; 15/353, 352; 96/414–416
See application file for complete search history.

(56) References Cited

U.S. PATENT DOCUMENTS

| | | | | |
|---|---|---|---|---|
| 6,572,668 | B1 * | 6/2003 | An et al. | 55/428 |
| 6,773,492 | B1 * | 8/2004 | West | 96/189 |
| 6,797,026 | B2 * | 9/2004 | Sechrist et al. | 55/348 |
| 6,884,273 | B2 * | 4/2005 | Kopec et al. | 55/346 |
| 7,097,680 | B2 * | 8/2006 | Oh | 55/343 |
| 7,273,506 | B2 * | 9/2007 | Oh et al. | 55/343 |
| 7,326,268 | B2 * | 2/2008 | Oh et al. | 55/343 |
| 7,377,953 | B2 * | 5/2008 | Oh | 55/426 |
| 7,410,516 | B2 * | 8/2008 | Ivarsson et al. | 55/337 |
| 7,419,522 | B2 * | 9/2008 | Arnold | 55/345 |
| 7,422,615 | B2 * | 9/2008 | Kim | 55/426 |
| 2005/0011170 | A1 * | 1/2005 | Christiansen et al. | 55/345 |

(Continued)

FOREIGN PATENT DOCUMENTS

| | | |
|---|---|---|
| CN | 2453827 | 10/2001 |

(Continued)

*Primary Examiner*—Jason M Greene
*Assistant Examiner*—Dung Bui
(74) *Attorney, Agent, or Firm*—McKenna Long & Aldridge LLP

(57) ABSTRACT

Object of the present invention is to provide a dust collecting device (100) for a vacuum cleaner of which dust collecting performance is improved. For this, the dust collecting device (100) includes a primary cyclone unit (110) having two parallel primary cyclones (111,112) for separating dust form air introduced therein by a cyclone principle, and a secondary cyclone (120) unit at a downstream of the primary cyclones (111,112) for cleaning the air again by the cyclone principle.

20 Claims, 8 Drawing Sheets

U.S. PATENT DOCUMENTS

| | | | | |
|---|---|---|---|---|
| 2005/0172585 | A1 | 8/2005 | Oh et al. | |
| 2005/0172586 | A1 | 8/2005 | Oh et al. | |
| 2005/0229554 | A1 * | 10/2005 | Oh et al. | 55/346 |
| 2006/0037172 | A1 * | 2/2006 | Choi | 15/353 |

FOREIGN PATENT DOCUMENTS

| | | |
|---|---|---|
| CN | 2478526 | 2/2002 |
| CN | 2647434 | 10/2004 |
| EP | 1 733 672 | 12/2006 |
| EP | 1 837 079 | 9/2007 |
| GB | 2 372 435 | 8/2002 |
| GB | 2 372 470 | 8/2002 |
| GB | 2 399 780 | 9/2004 |
| GB | 2 406 067 | 3/2005 |
| JP | 2004-135700 | 5/2004 |
| KR | 10-2005-0108623 | 11/2005 |
| KR | 10-0611067 | 8/2006 |
| KR | 10-2008-0032181 | 4/2008 |

* cited by examiner

[Fig. 1]
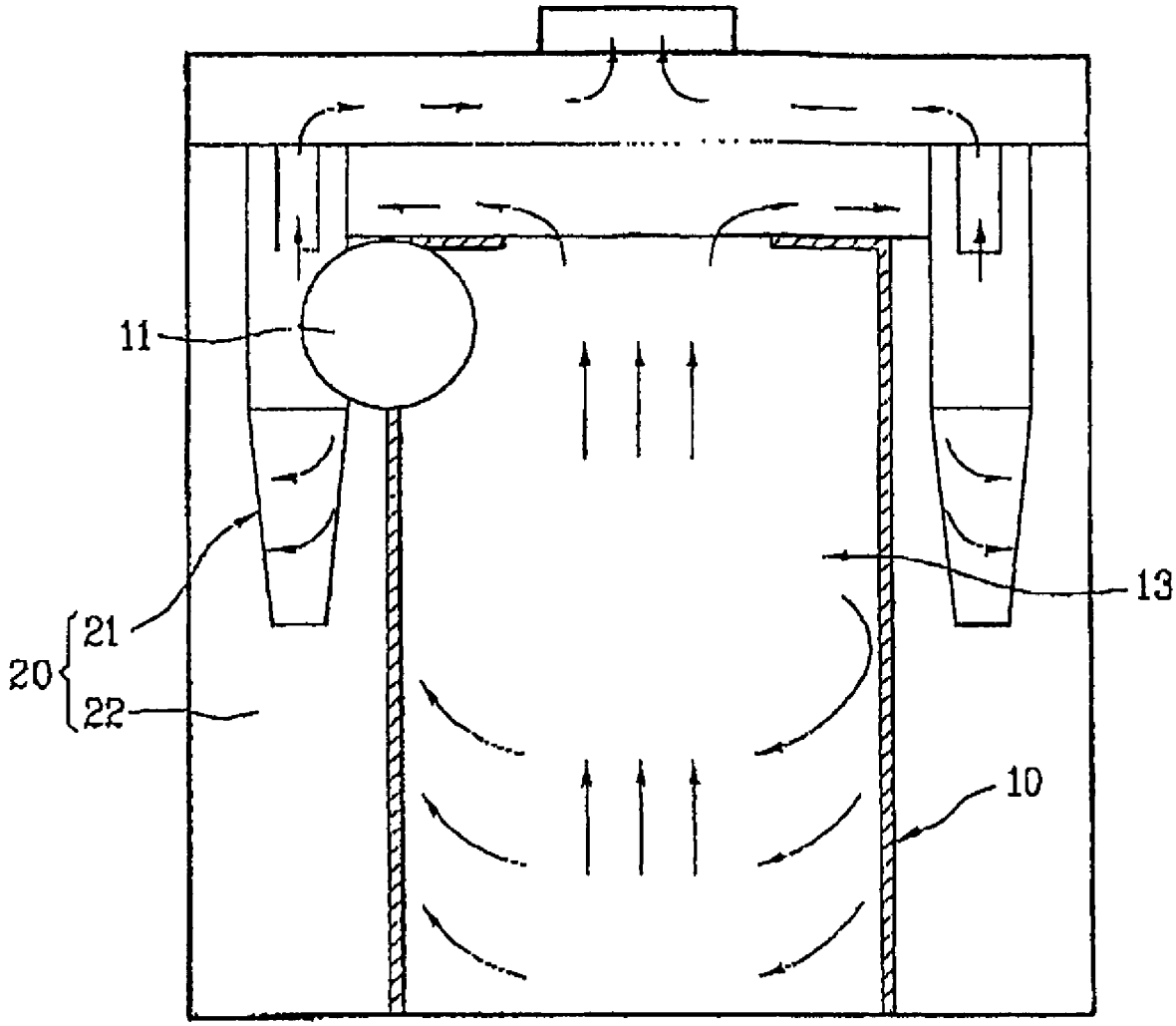

[Fig. 2]
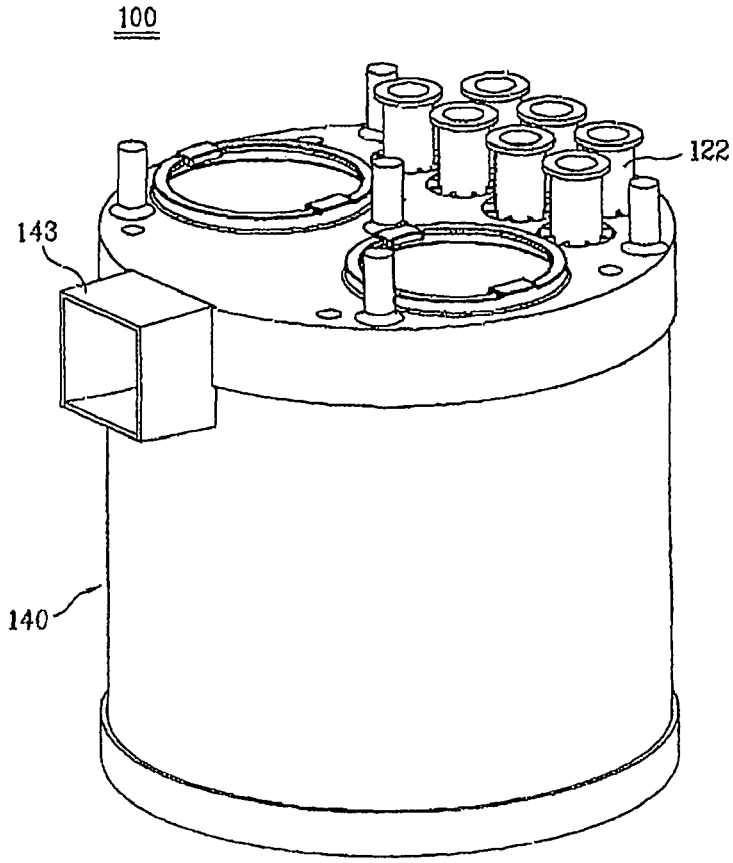
[Fig. 3]
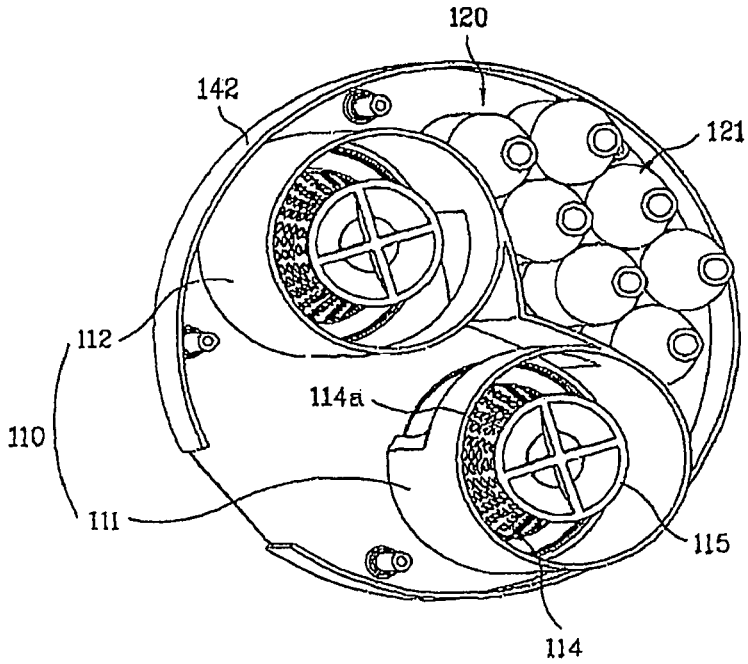

[Fig. 4]
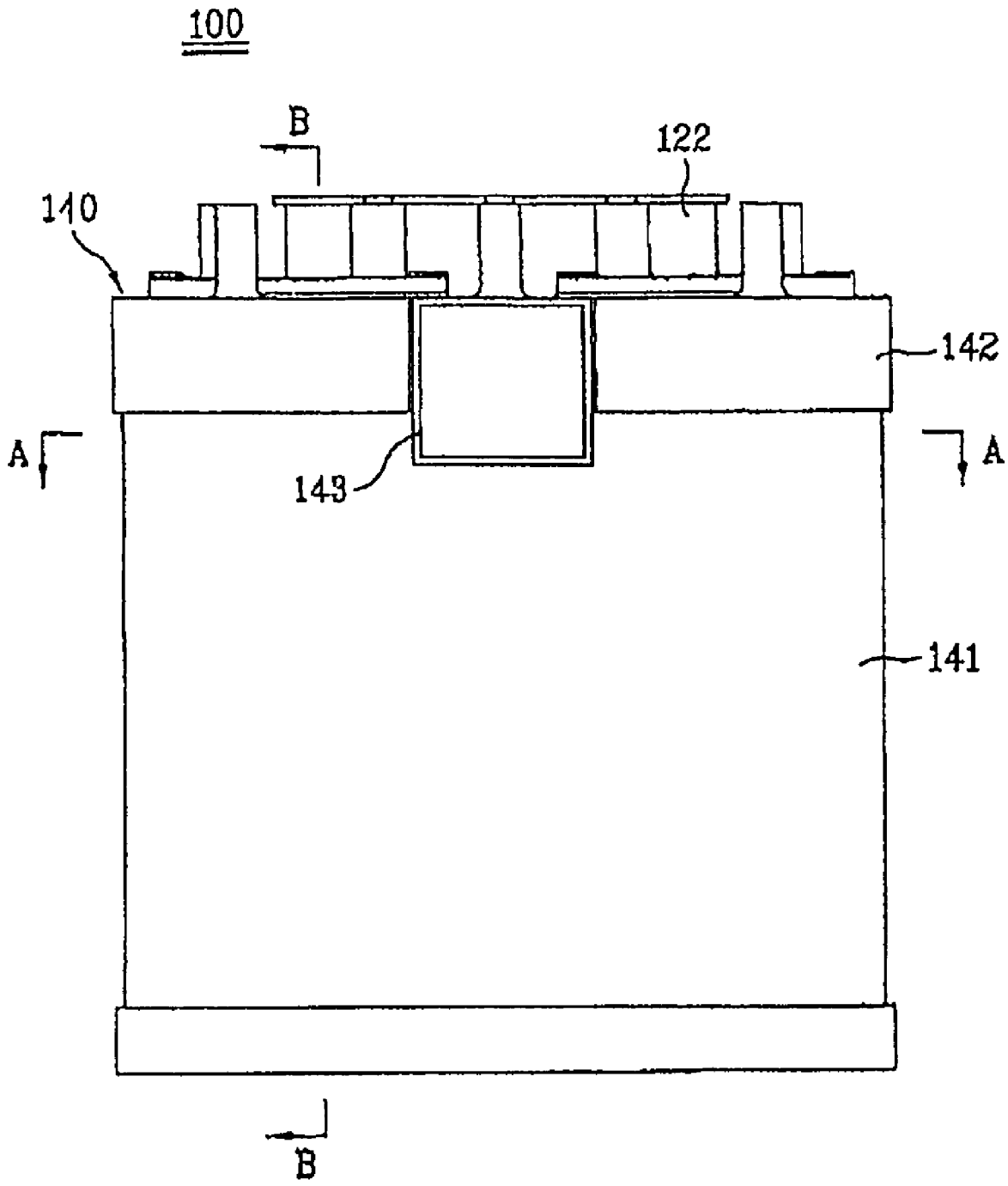

[Fig. 5]
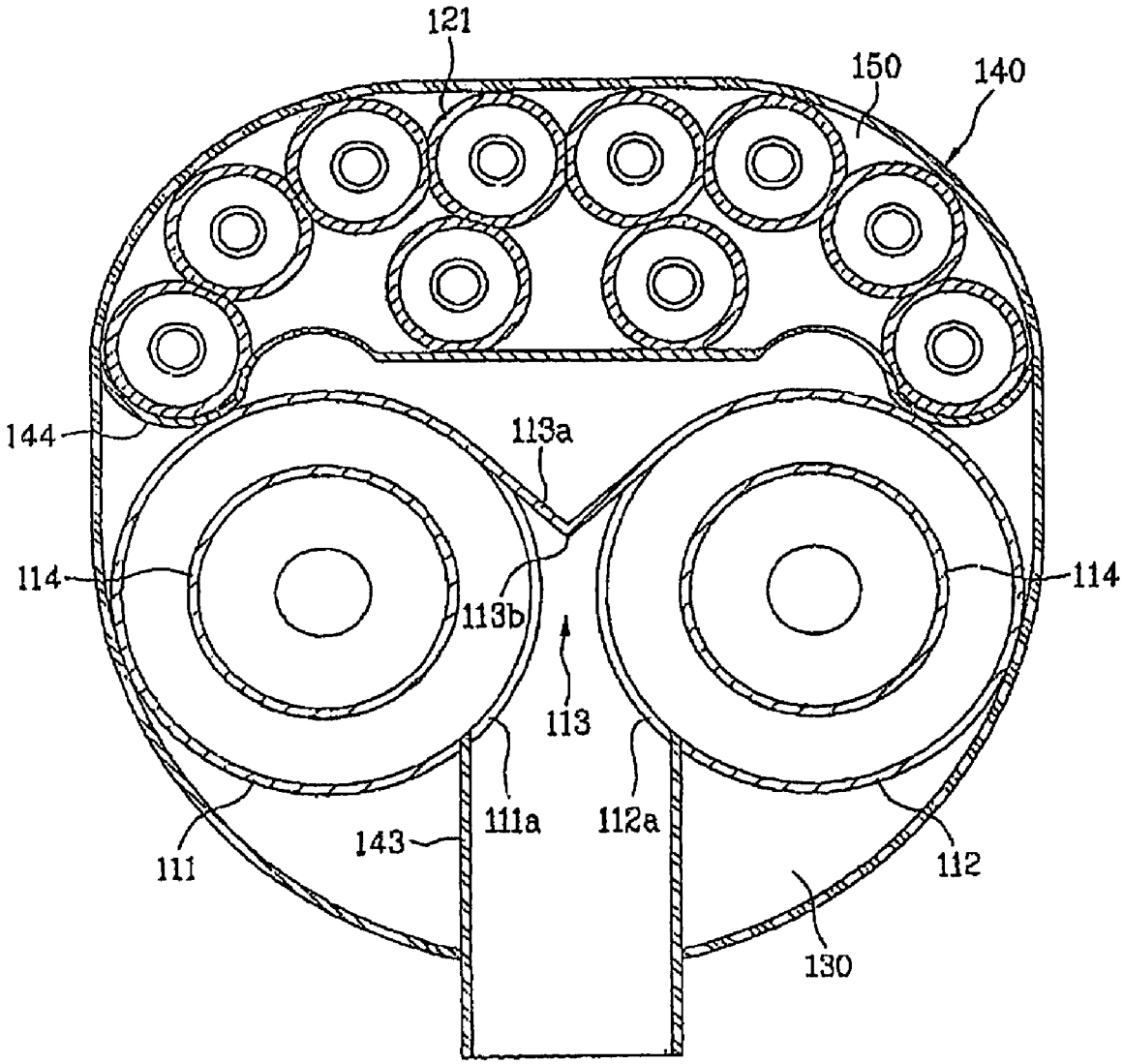

[Fig. 6]
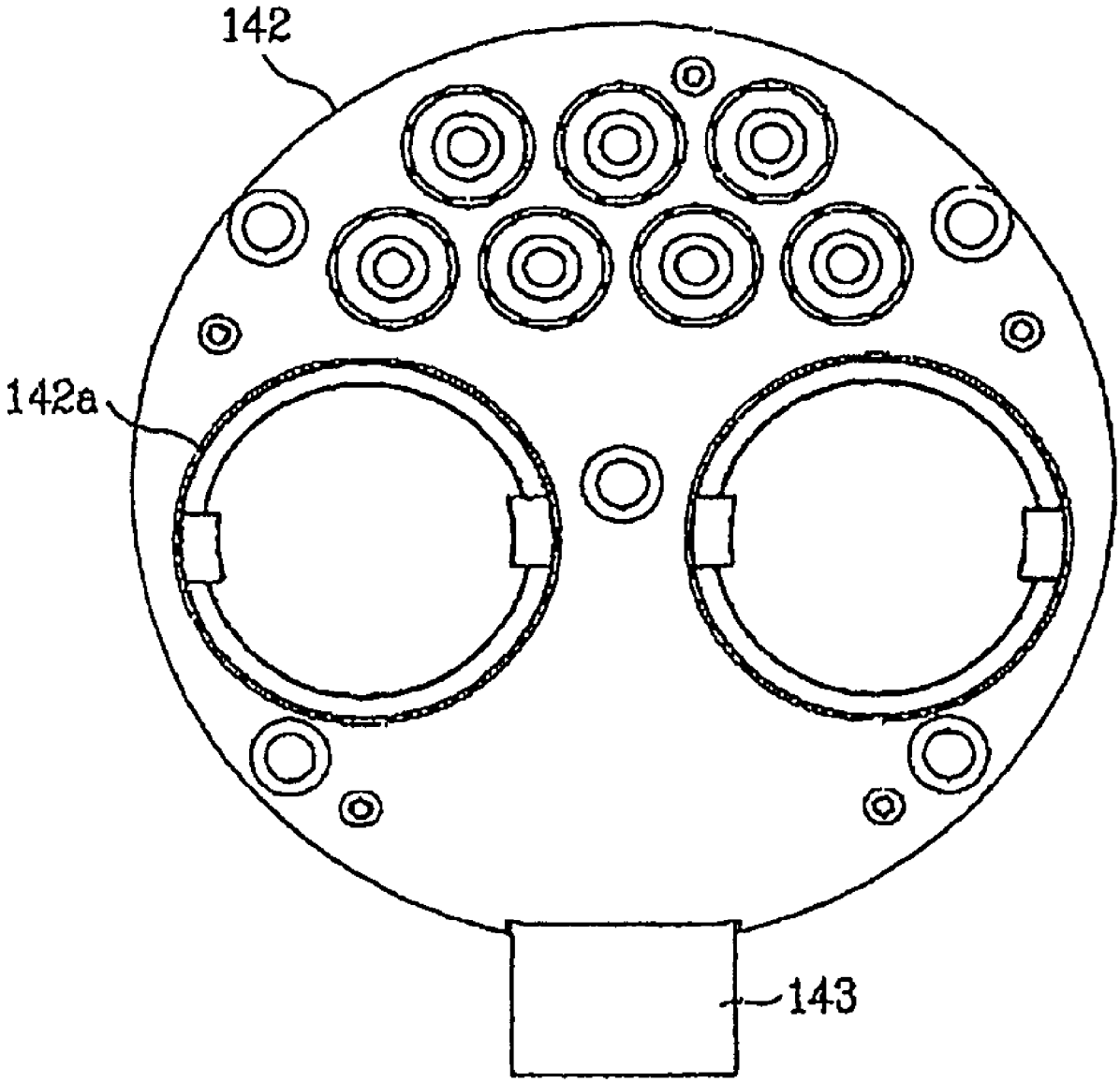

[Fig. 7]
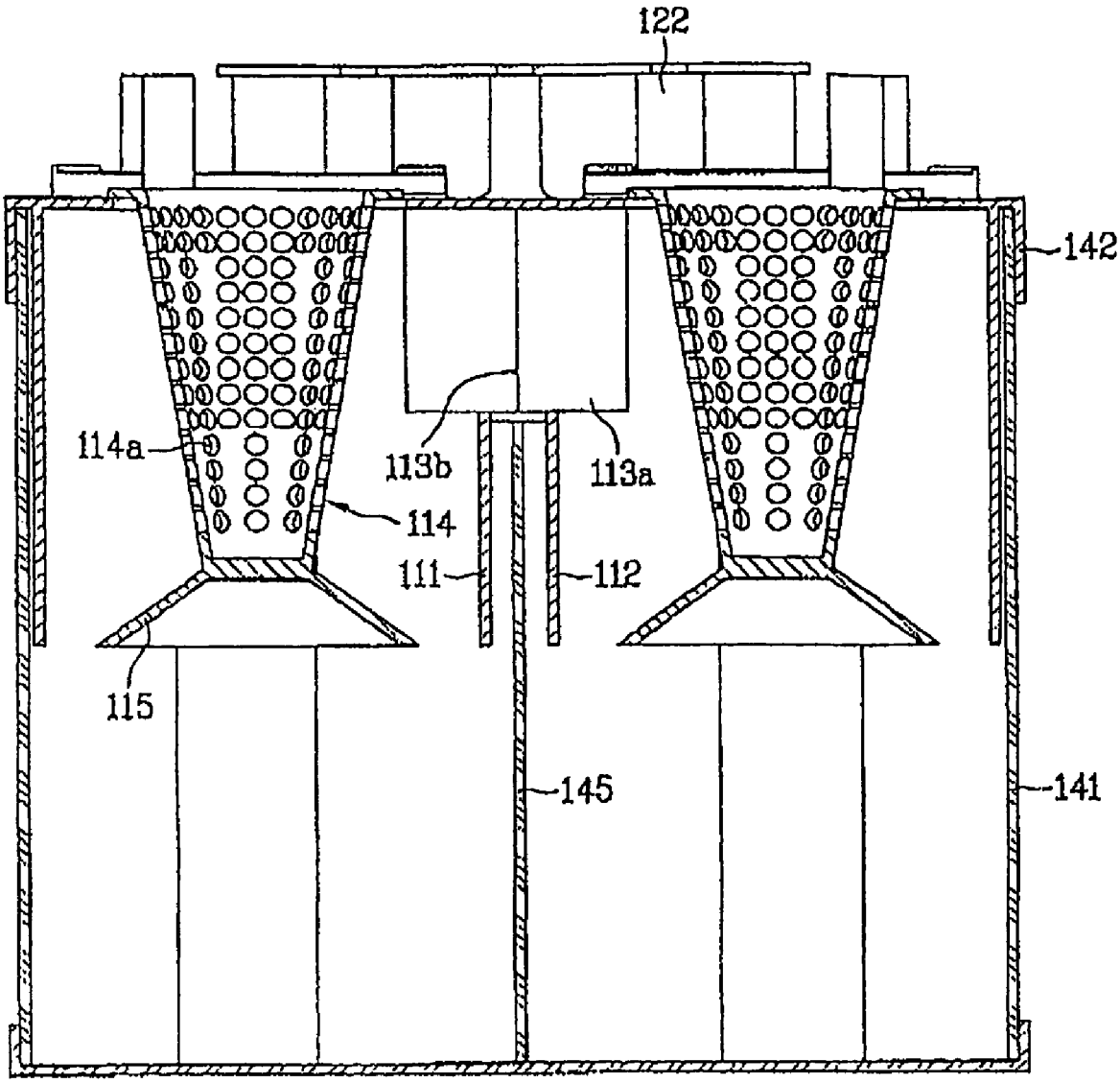

[Fig. 8]
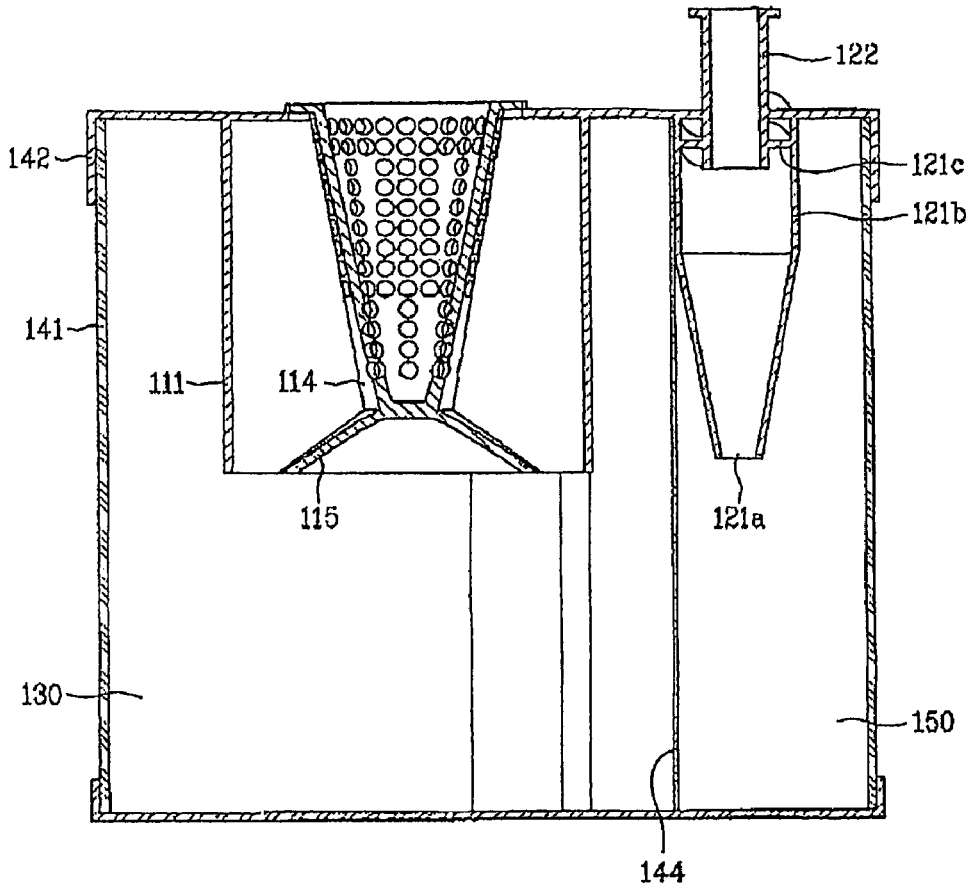
[Fig. 9]
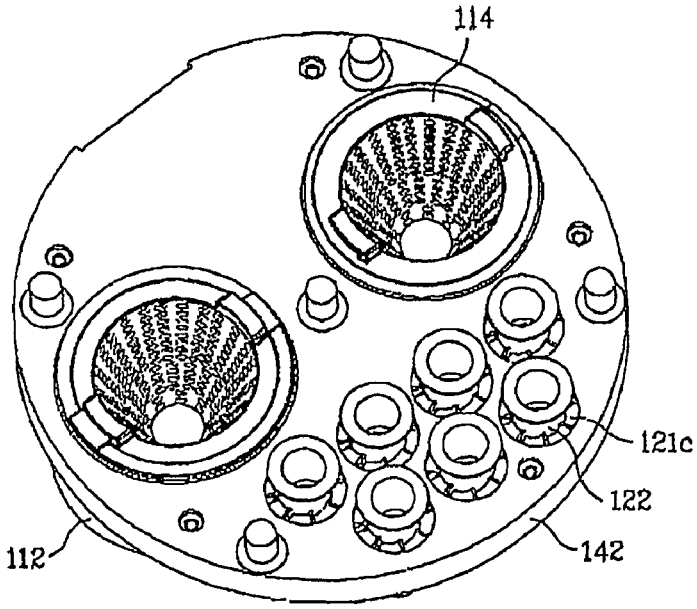

[Fig. 10]
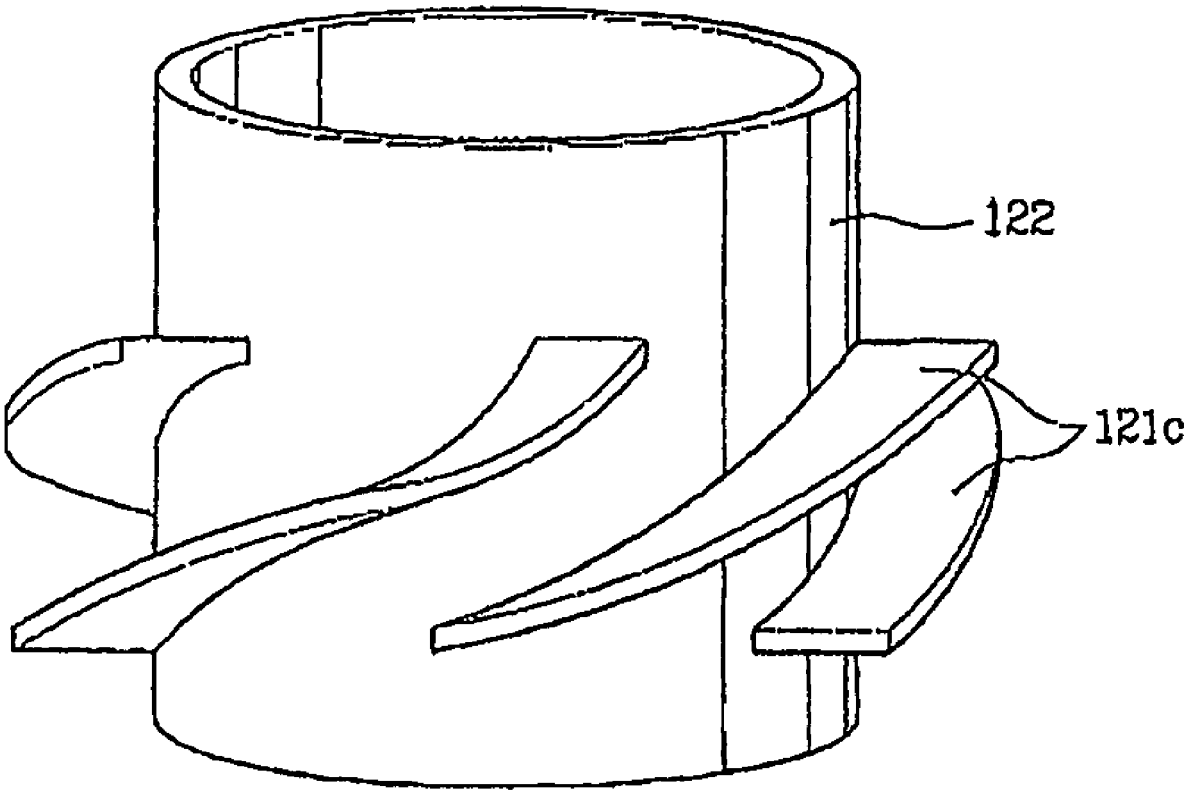

DUST COLLECTING DEVICE FOR VACUUM CLEANER

This application claims the benefit of PCT Patent Application No. PCT/KR2005/002688, filed Aug. 17, 2005, which is hereby incorporated by reference in its entirety.

TECHNICAL FIELD

The present invention relates to a dust collecting device for a vacuum cleaner, and more particularly, to a dust collecting device for a vacuum cleaner which collects dust by a cyclone principle.

BACKGROUND ART

In general, the cyclone dust collecting device is applied to a vacuum cleaner, for separating foreign matters, such as dust, from circulating air, to collect the dust.

The cyclone principle utilizes a difference of centrifugal forces for separating foreign matters, such as dust, from air circulating in a spiral.

Recently, the cyclone dust collecting device, collecting dust by using the cyclone principle, is generally applied to the vacuum cleaner owing to advantages of the cyclone dust collecting device in that dust collecting performance is good and dust can be removed easily compared to a bag-type dust collecting device in which a dust bag is mounted in an air flow passage for collecting dust.

A related art dust collecting device for a vacuum cleaner will be described with reference to FIG. 1.

The related art dust collecting device is provided with a primary cyclone dust collecting unit 10 for drawing contaminated air containing dust and collecting comparatively large sized particles of the dust therefrom, and a secondary cyclone dust collecting unit 20 on an outside of the primary cyclone dust collecting unit 10 for collecting comparatively small sized particles of the dust.

The primary cyclone dust collecting unit 10, a cylindrical container having a bottom in close contact with a bottom of the dust collecting device, has a suction pipe 11 in a side surface of an upper portion for introduction of contaminated air containing foreign matters in a tangential direction of an inside wall of the primary cyclone dust collecting unit, and a discharge opening 12 at a center of a top for discharging air cleaned primarily.

According to this, the primary cyclone dust collecting unit 10 has an upper space forming a primary cyclone 13 for separating foreign matters by centrifugal force, and a lower space forming a primary dust storage portion 14 for storing foreign matters separated by the centrifugal force.

In the meantime, the air from the discharge opening 12 is introduced to the secondary cyclone dust collecting unit 20, and discharged upward after passed through a dust separating step, again.

In more detail, the secondary cyclone dust collecting unit 20 includes a plurality of small sized secondary cyclones 21 arranged in a circumferential direction around the upper portion of the primary cyclone dust collecting unit 10, and a secondary dust storage portion 22 for storing dust separated at the secondary cyclone dust collecting unit 21.

The secondary dust storage portion 22 is under the secondary cyclones 21 around the primary dust storage portion. The primary dust storage portion 14 and the secondary dust storage portion 22 are separated by an outside wail of the primary cyclone dust collecting unit 10.

However, the related art dust collecting device has a problem in that a dust collecting performance of the primary cyclone dust collecting unit that collects a major portion of the dust is poor because the foreign matters, such as dust, is separated and collected only with single primary cyclone unit.

Moreover, the related art dust collecting device has problems in that fabrication of the related art dust collecting device is difficult, a structure is complicate, air tightness between the cleaner body and the suction pipe is poor, because the suction pipe is connected to an outside wall of the primary cyclone unit in a tangential direction substantially for guiding air containing dust in a substantially tangential direction of the inside wall of the primary cyclone unit.

Moreover, since an inside diameter of the primary cyclone unit is the same in overall, the dust in the dust storage portion at a lower portion of the primary cyclone unit flies to an upper portion of the primary cyclone unit by the spiral circulation of the air in the primary cyclone unit, thereby leading the dust collecting performance poor.

Furthermore, because the secondary cyclone unit is around the primary cyclone unit, and the secondary dust storage portion is around the primary dust storage portion, the related art dust collecting device has problems in that fabrication of the dust collecting device is difficult, cleaning of the secondary dust storage portion is difficult due to a small width of the secondary dust storage portion, and determining an amount of dust accumulated in the primary dust storage portion is difficult.

DISCLOSURE OF INVENTION

Technical Problem

An object of the present invention is to provide a dust collecting device for a vacuum cleaner, which has an improved dust collecting performance.

Technical Solution

The object of the present invention can be achieved by providing a dust collecting device for a vacuum cleaner including a primary cyclone unit having two parallel primary cyclones for separating dust from air introduced therein by a cyclone principle, and a secondary cyclone unit at a downstream of the primary cyclones for cleaning the air again by the cyclone principle.

The primary cyclone unit further includes a suction guide portion between the primary cyclones for guiding the air containing dust to the primary cyclones.

Preferably, the suction guide portion includes a guide surface for guiding the air containing dust to inlets to the primary cyclones.

The guide surface has one side connected to an edge of the inlet of one of the primary cyclones, the other side connected to an edge of the inlet of the other the primary cyclones, and a middle portion projected toward an inside of the suction guide portion as it goes toward the middle portion from the one side and the other side the more.

The dust collecting device further includes a dust collecting container having the primary cyclones and a primary dust storage portion for storing dust separated by the primary cyclones.

Each of the primary cyclones is provided in the dust collecting container such that an axis thereof lies in an up/down direction, having an inlet in an upper outside circumferential surface, and a bottom end spaced a predetermined distance from a bottom of the primary dust storage portion, and designed to discharge the dust to the primary dust storage portion through the bottom of each of the primary cyclones.

Each of the primary cyclones may have a top end connected to an upper cover openably provided on a top of the dust collecting container, and an outside circumferential surface adjacent to an inside wall of the dust collecting container.

The primary dust storage portion has a bottom area larger than bottom areas of the primary cyclones.

The dust collecting container may further include a partition wall for dividing the primary dust storage portion into a portion for storing dust separated by one of the primary cyclones, and a portion for storing dust separated by the other one of the primary cyclones.

The dust collecting container includes a suction pipe for guiding air containing dust to the primary cyclone unit, wherein the suction pipe has an inlet projected from an upper center of an outside circumferential surface of the dust collecting container, and an axis passing through a middle portion of the primary cyclone unit when seen from above the dust collecting container.

The dust collecting device may further include a hollow air discharge member in each of the primary cyclones, the air discharge member being in communication with the outlet of the primary cyclone and having pass through holes of predetermined sizes in an outside circumferential surface for discharging air.

In the meantime, preferably, the primary cyclone unit is provided to one side of the dust collecting container, and the secondary cyclone unit includes a plurality of secondary cyclones provided tote other side, of the dust collecting container.

The secondary cyclones have axes each formed in an up/down direction, and bottoms each with dust outlet.

A secondary dust storage portion is provided under the secondary, cyclones on the other side of the dust collecting container separate from the primary dust storage portion for storing dust separated by the secondary cyclone unit, and a portion of an outside wall of the primary dust storage portion forms a portion of an outside wall of the dust collecting container, and a portion of an outside wall of the secondary dust storage portion forms a portion of an outside wall of the dust collecting container.

Preferably, the dust collecting container includes an inside dust collecting container on the other side of the dust collecting container to surround the secondary cyclones to form the secondary dust storage portion.

Preferably, the dust collecting container has an openable bottom which forms bottoms of the primary dust storage portion and the secondary dust storage portion.

Each of the secondary cyclones includes a secondary cyclone body having an inlet at a top, and a spiral circulation forming member provided to an inside of the secondary cyclone body for forming a spiral circulation in the secondary cyclone body.

The spiral circulation forming member may include at least one blade provided to an upper portion of the secondary cyclone body.

The at least one blade is provided to an outside circumferential surface of an air discharge pipe inserted in an upper portion of the secondary cyclone body for guiding air from the secondary cyclone body.

The secondary cyclones are arranged at least in two rows on one side of the dust collecting container, or in one row along a circumferential direction of the dust collecting container on an inside of the dust collecting container within a predetermined section.

Preferably, the primary cyclones are provided in the same size on a front side of the dust collecting container side by side, and the secondary cyclones are provided to a rear side of the dust collecting container.

ADVANTAGEOUS EFFECTS

The parallel arrangement of the two primary cyclones improves a dust collecting performance of the primary cyclone unit which separates a major portion of the dust, to improve a performance of the dust collecting device, on the whole.

BRIEF DESCRIPTION OF THE DRAWINGS

The accompanying drawings; which are included to provide a further understanding of the invention, illustrate embodiment(s) of the invention and together with the description serve to explain the principle of the invention. In the drawings;

FIG. 1 illustrates a section of a related art cyclone dust collecting device;

FIG. 2 illustrates a perspective view of a dust collecting device in accordance with a preferred embodiment of the present invention;

FIG. 3 illustrates a perspective view of an upper cover of the dust collecting device in FIG. 2 seen from a bottom side;

FIG. 4 illustrates a front view of the dust collecting device in accordance with a present invention;

FIG. 5 illustrates a section across a line A-A in FIG. 5;

FIG. 6 illustrates a plan view of the upper cover in FIG. 3;

FIG. 7 illustrates a longitudinal section across a center of a primary cyclone unit in a left/right direction of a dust collecting device in accordance with a preferred embodiment of the present invention;

FIG. 8 illustrates a longitudinal section across a line B-B in FIG. 5;

FIG. 9 illustrates a perspective view of the upper cover of the dust collecting device in FIG. 2 seen from above; and FIG. 10 illustrates a perspective view of an embodiment of a spiral flow forming member in a dust collecting device of the present invention.

BEST MODE FOR CARRYING OUT THE INVENTION

Reference will now be made in detail to the preferred embodiments of the present invention, examples of which are illustrated in the accompanying drawings. Wherever possible, the same names and reference numbers will be used throughout the drawings to refer to the same or like parts, and repetitive description of which will be omitted.

As one embodiment of a vacuum cleaner having a dust collecting device in accordance with a preferred embodiment of the present invention applied thereto, a canister type vacuum cleaner will be described.

The vacuum cleaner includes a suction nozzle for drawing air containing foreign matters while moving along a floor to be cleaned, a cleaner body provided separate from the suction nozzle, and a connection pipe connected between the suction nozzle and the cleaner body for guiding contaminated air from the suction nozzle to the cleaner body.

The suction nozzle has a predetermined size of nozzle suction opening in a bottom for drawing dust from the floor by air suction force generated at the cleaner body.

Mounted inside of the cleaner body, there are an electric unit for controlling the vacuum cleaner, and a motor-fan assembly for drawing air.

In more detail, the cleaner body has a hose connection portion at a front upper center for connecting the connection pipe thereto, wheels rotatably mounted at opposite sides of a rear of the cleaner body for smooth moving of the cleaner body on the floor, and a caster at a front portion of a bottom of the cleaner body, for changing a direction of the cleaner body.

In the meantime, the cleaner body has the dust collecting device in accordance with a preferred embodiment of the present invention detachably mounted thereto for separating and collecting foreign matters, such as dust.

Air from the dust collecting device passes a predetermined air discharge passage in the cleaner body, and the motor-fan assembly, and is discharged to an outside of the cleaner body.

The dust collecting device may be mounted to a rear portion of the cleaner body or a front portion of the cleaner body.

For this, the cleaner body has a dust collecting device mounting portion for mounting the dust collecting device.

Between the hose connection portion and the dust collecting device mounting portion, there is a suction flow passage passed through a middle portion of the cleaner body.

The dust collecting device 100 in accordance with a preferred embodiment of the present invention will be described with reference to a case the dust collecting device is mounted to the rear portion of the cleaner body.

FIG. 2 illustrates a perspective view of a dust collecting device in accordance with a preferred embodiment of the present invention, and FIG. 3 illustrates a plan view of a dust collecting device in accordance with a preferred embodiment of the present invention.

Referring to FIGS. 2 and 3, the dust collecting device 100 in accordance with a preferred embodiment of the present invention includes a primary cyclone unit 110 having two primary cyclones 111, and 112 arranged in parallel, and a secondary cyclone unit 120 in a downstream of the primary cyclones 111, and 112, for maximizing a dust collecting performance.

The primary cyclones 111, and 112 separate dust from air introduced thereto by a cyclone principle, and the secondary cyclone unit 120 also cleans the air again by the cyclone principle.

In the cyclone principle, foreign matters, such as dust, are separated from air circulating in a spiral by using a difference of centrifugal forces between the air and the dust.

Referring to FIGS. 3 to 5, it is preferable that a suction guide portion 113 is provided between the primary cyclones 111, and 112, for guiding the air containing dust to the primary cyclones 111, and 112.

Preferably, the suction guide portion 113 includes a guide surface 113*a* for guiding the air containing dust to inlets of the primary cyclones, respectively.

The guide surface 113*a* has one side connected to an edge of an inlet of one of the primary cyclones, the other side connected to an edge of an inlet of the other the primary cyclones, and a middle portion projected toward an inside of the suction guide portion 113 as it goes toward the middle portion 113*b* from the one side and the other side the more.

In addition to this, the suction guide portion 113 may have a split plate (not shown) on an inside thereof for splitting the air flowing toward the primary cyclones 111, and 112 guided by the suction guide portion 113 into two sides.

Moreover, the dust collecting device 100 in accordance with a preferred embodiment of the present invention further includes a dust collecting container 140 having the primary cyclones 111, and 112, and a primary dust storage portion 130 provided therein.

The primary dust storage portion 130 stores dust separated at the primary cyclone unit 110.

The primary cyclones 111, and 112 are mounted in the dust collecting container 140 such that axes thereof are arranged in an up/down direction.

It is preferable that each of the primary cyclones 111, and 112 has an inlet 111*a*, or 112*a* in an upper outside circumferential surface, and a bottom spaced a predetermined distance away from a bottom of the primary dust storage portion 130.

The foreign matters, such as dust, separated in the primary cyclones 111, and 112 by the cyclone principle is discharged to the primary dust storage portion 130 through the bottoms of the primary cyclones 111, and 112.

For this, each of the primary cyclones 111, and 112 is the bottom fully opened or has dust discharge holes (not shown) formed along a bottom circumference.

In more detail it is preferable that each of the primary 111, and 112 has a cylindrical container substantially. The concept of the substantially cylindrical shape includes that each of the primary cyclones 111, and 112 is cylindrical, with a portion of a sidewall thereof being cut away, or having a slightly different shape, or the like.

Each of the primary cyclones 111, and 112 may have a top end connected to a top end of the dust collecting container 140.

It is preferable that the dust collecting container 140 forms an exterior of the dust collecting device in accordance with a preferred embodiment of the present invention, and has an openable top portion.

In more detail, the dust collecting container 140 includes a cylindrical body 141 having an opened top, and an upper cover 142 for opening/closing the top end of the cylindrical body.

According to this, the upper cover 142 is mounted on the top of the dust collecting container 140, openably.

It is preferable that the primary cyclones 111, and 112 have top ends connected to the upper cover 142, and outside circumferences close to the inside wall of the dust collecting container 140, for maximizing sizes of the primary cyclones.

The concept of "close" includes that the outside circumferences of the primary cyclones 111, and 112 are in contact with the inside circumferential surface of the dust collecting container 140, or there are small gaps between the outside circumferential surfaces of the primary cyclones 111, and 112 and the dust collecting container 140.

Of course, a portion of the outside wall of the primary cyclones 111, and 112 may be formed as a unit with the inside wall of the body 141 of the dust collecting container.

Referring to FIG. 6, the upper cover 142 has outlets 142*a* for discharging air cleaned at the primary cyclones 111, and 112.

For convenience of description, with reference to a state the dust collecting device 100 is mounted to the cleaner body (not shown), a primary cyclone provided to a left side of the dust collecting container 140 is called as a left side cyclone 111, and a primary cyclone provided to a right side of the dust collecting container 140 is called as a right side cyclone 112.

Referring to FIGS. 5 and 7, the inlet 111*a* to the left side cyclone is formed at a left side of the outside circumference of the left side cyclone, and the inlet 112*a* to the right side cyclone is formed at a light side of the outside circumference of the right side cyclone, such that the inlet 111*a* to the left side cyclone faces the inlet 112*a* to the right side cyclone.

The guide surface 113*a* of the suction guide portion has a left end connected to a rear edge of the inlet 111*a* to the left side cyclone, a right end connected to a rear edge of the inlet 112*a* to the right side cyclone, and a middle portion 113*b* projected forward the more as it goes to the middle the more.

In the meantime, the dust collecting container 140 includes a suction pipe 143 having an inlet projected from an upper center of an outside circumferential surface, and an axis passing through a middle portion of the primary cyclone unit 110.

When seen from an upper side of the dust collecting container 140, the axis of the suction pipe 143 divides the primary cyclone unit 110 equally, and serves to guide the air containing dust to the primary cyclone unit 110.

In more detail, a rear end of the suction pipe 143 has opposite sidewalls each connected to an outside circumferential surface of the left side cyclone 111 and an outside circumferential surface of the right side cyclone 112, both of which form inlets of the suction guide portion 113, and a front end projected forward to a predetermined height from an upper center of the body 141 of the dust collecting container, to form a portion of an inlet.

If the inlet of the suction pipe 143 is formed in the upper center of the dust collecting container body 141 thus, the suction flow passage of the cleaner body and the suction pipe 143 are almost in a straight line, leading to reduce a flow resistance and a flow length, and improves air tightness between the suction flow passage and the suction pipe 143.

In this instance, though the rear end of the suction pipe 143 can be connected to a front edge of the inlet 111*a* to the left cyclone, and a front edge of the inlet 112*a* to the right side cyclone directly, it is preferable that a width between the front edge of the inlet 111*a* to the left cyclone, and the front edge of the inlet 112*a* to the right side cyclone is smaller than a width of the suction pipe 143.

When the dust collecting container 140 is seen from above, the axis of the suction pipe 143 passes the middle portion 113*b* of the guide surface to divide the entire dust collecting container 140 into a left side and a right side, equally.

In this instance, the axis of the suction pipe 143 may be formed horizontally, or sloped downwardly at a predetermined angle as it goes toward a rear side the more.

In addition to this, it is preferable that each of the primary cyclones 111, and 112 has a hollow air discharge member 114 therein.

In more detail, the air discharge member 114 is, in communication with the outlets 142*a* of the primary cyclones, and has pass through holes 114*a* of predetermined sizes in an outside circumferential surface for discharging air.

For this, a top end of the air discharging member 114 is opened for enabling air discharge, and detachably connected to an edge of the outlets 142*a* of the primary cyclones.

At a bottom end of the air discharge member 114, there is a fly preventive member 115 having a shape with a horizontal sectional area which becomes the larger as it goes to a lower side the more, for minimizing fly of the dust by the spiral circulation in the primary dust storage portion 130.

The air discharge member 114 may be cylindrical or have a shape with a sectional area across an axis direction which becomes the smaller as it goes toward a lower side the more.

In the meantime, the primary cyclone unit 110 is provided to one side portion of the dust collecting container 140, and the secondary cyclone unit 120 is provided to the other portion of the dust collecting container 140.

In the embodiment, the secondary cyclone unit 120 is provided to a rear side of the primary cyclone unit 110. Accordingly, the primary cyclone unit 110 is provided to a front side of the dust collecting container 140, and the secondary cyclone unit 120 is provided to the rear side.

The secondary cyclone unit 120 will be described in more detail, with reference to FIGS. 8 to 10.

The secondary cyclone unit 120 includes a plurality of secondary cyclones 121 provided to a rear side of the dust collecting container 140.

The secondary cyclones 121 have vertical axes respectively, and dust outlets 121*a* at a bottom ends respectively.

Each of the secondary cyclones 121 includes a secondary cyclone body 121*b* having a cylindrical shape or a shape with an area of a section perpendicular to an axis direction which becomes the smaller as it goes toward a lower side, and a spiral circulation forming member provided to the secondary cyclone body 121*b* for forming a spiral circulation in the secondary cyclone body 121*b*.

Of course, the secondary cyclone body 121*b* may have a shape of a combination of the two shapes. For an example, the secondary cyclone unit 121 may include a cylindrical upper body and a lower body at a lower end of the body, of a shape which has an area of a section perpendicular to an axis direction which becomes the smaller as it goes toward a lower side the more.

In this instance, a bottom end of the lower body is opened to form the dust outlet 121*a*.

The spiral circulation forming member includes at least one blade 121*c* provided to an inside of the secondary cyclone body 121*b*. In this instance, the at least one blade 121*c* is provided to an upper side of the secondary cyclone body 121*b*.

In more detail, the at least one blade 121*c* is provided to an outside circumferential surface of the air discharge pipe 122 to be inserted to the upper side of the secondary cyclone body 121*b*.

It is preferable that the air discharge pipe 122 serves to discharge the air cleaned at the secondary cyclone 121, and is cylindrical.

In this instance, the blade 121*c* may have an inside surface formed as one body with an outside circumferential surface of the air discharge pipe 122, and an outside surface formed as one body with an inside circumferential surface of the secondary cyclone body 121*b*.

It is preferable that a plurality of the blades 121*c* are provided to the outside circumferential surface of the air discharge pipe 122 at regular intervals in a circumferential direction of the air discharge pipe.

The secondary cyclones 121 may be arranged in two rows on a rear side of the primary cyclones, or in one row along a circumferential direction of the dust collecting container on an inside of the dust collecting container 140 within a predetermined section.

In the meantime, at the other side of the dust collecting container 140, i.e., a rear side of the dust collecting container 140, there is a secondary dust storage portion 150 separate from the primary dust storage portion 130 for storing dust separated at the secondary cyclone unit 120.

In this instance, it is preferable that a portion of an outside wall of the primary dust storage portion forms a portion of an outside wall of the dust collecting container 140, and a portion of an outside wall of the secondary dust storage portion 150 forms a portion of an outside wall of the dust collecting container 140.

More preferably, it is more preferable to maximize a capacity of the dust storage portion including the primary dust storage portion 130 and the secondary dust storage portion 150 by making the outside wall of the primary dust storage portion 130 form a major portion of the outside wall of the dust collecting container 140, and the outside wall of the secondary dust storage portion 150 form rest of the outside wall of the dust collecting container 140.

For this, it is preferable that the dust collecting container 140 includes an inside dust collecting container 140 which surrounds the secondary cyclones 121, with a bottom end in close contact with a bottom of the dust collecting container 140.

In the embodiment, a rear outside wall of the inside dust collecting container 144 forms a rear outside wall of the dust collecting container 140.

Of course, the rear outside wall of the inside dust collecting container 144 may be in contact with the rear inside wall of the dust collecting container 140.

The bottom of the dust collecting container 140 forms bottoms of the primary dust storage portion 130 and the secondary dust storage portion 150, and it is preferable that the bottom of the dust collecting container 140 is openable for easy discharge of dust from the primary dust storage portion 130 and the secondary dust storage portion 150.

Moreover, it is preferable that the primary dust storage portion 130 has a bottom area larger than bottom areas of the primary cyclones 111, and 112.

In more detail, since the primary cyclones 111, and 112 are provided in an up/down direction in a space the outside walls of the inside dust collecting container 140 and the dust collecting container 140, the primary dust storage portion 130 has a bottom area larger than bottom areas of the primary cyclones 111, and 112.

According to this, the primary dust storage portion 130 becomes to have a greater capacity. Moreover, since the dust falling down while circulating in a spiral spreads in a radial pattern toward the inside wall of the primary dust storage portion 130 by centrifugal force as the dust passes the bottom ends of the primary cyclones 111, and 112, the dust is prevented from being drawn into the air discharge members 114 by air discharged from the primary cyclones 111, and 112.

In addition to this, the dust collecting container 140 further includes a partition wall for partitioning the primary dust storage portion 130.

The partition wall 145 divides the primary dust storage portion 130 into a left side dust storage portion 130, and a right side dust storage portion equally, so that the dust separated by the left side cyclone 111 and the dust separated by the right side cyclone 112 are not mixed with each other.

Moreover, the partition wall 145 prevents the spiral circulations of air formed by the left side cyclone 111 and the right side cyclone 112 from giving an influence to each other, thereby preventing fly of the dust, and minimizing noise.

Moreover, in order to enable to determine an amount of dust stored in the primary dust storage portion 130 and the secondary dust storage portion 150, it is preferable that the outside wall of the dust container 140 is formed of a material which can be see-through.

In the meantime, though not shown, on a top of the upper cover 142, there is a cap provided thereto for forming an air flow chamber to make air from the primary cyclones 111, and 112 to flow to the secondary cyclones 121.

It is preferable that the cap is openably provided to the upper cover 142, and has a plurality, of air discharge holes in a rear side connected to the air discharge pipes 122.

The operation of the vacuum cleaner having the dust collecting device 100 of the present invention applied thereto will be described.

Upon putting the vacuum cleaner into operation; external contaminated air is introduced to the primary cyclones 111, and 112 through the suction nozzle and the connection pipe via the suction pipe 143, and the suction guide portion 113.

In more detail, the air introduced to the suction guide portion 113 through the suction pipe 143 is guided by the inside walls of the primary cyclones 111, and 112 to circulate in a spiral in the primary cyclones 111, and 112.

According to this, comparatively heavy and large particles of the dust are separated by the cyclone principle, fall down, and stored in the primary dust storage portion 130. Fly of the dust stored in the primary dust storage portion 130 is prevented by the fly preventive members 115.

The air having the comparatively large particles separated therefrom is discharged to an upper side of the upper cover 142 through the air discharge member 114 and the outlets 142*a*, and introduced to the plurality of secondary cyclones 121 to pass through a dust separating step, again.

In this instance, the blades 121*c* form a spiral circulation of air inside of the secondary cyclones 121.

The air cleaned again by the secondary cyclones 121 is discharged through the air discharge pipe 122, passes a predetermined air discharge flow passage in the cleaner body and the motor-fan assembly, and is discharged to an outside of the cleaner body.

In the meantime, the dust collecting device of the present invention is applicable both to the canister type vacuum cleaner, and the upright type vacuum cleaner.

It will be apparent to those skilled in the art that various modifications and variations can be made in the present invention without departing from the spirit or scope of the inventions.

Thus, it is intended that the present invention covers the modifications and variations of this invention provided they come within the scope of the appended claims and their equivalents.

INDUSTRIAL APPLICABILITY

The dust collecting device of the present invention having the foregoing design has the following advantages.

First, the parallel arrangement of the two primary cyclones improves a dust collecting performance of the primary cyclone unit which separates a major portion of the dust, to improve a performance of the dust collecting device, on the whole.

Second, the provision of the suction pipe for guiding air to the two parallel primary cyclones improves air tightness to the cleaner body, and enables to fabricate easily.

Third, the sectional area of the dust storage portion formed larger than the sectional area of the bottom of the cyclone permits to minimize an influence of discharging air to the dust, thereby improving a dust separating performance.

Fourth, the provision of the primary dust storage portion adjacent to the secondary dust storage portion in the dust collecting container permits easy cleaning of the dust container, and easy removal of the dust.

Fifth, the easy determination of the amount of dust in the primary dust storage portion which stores a major portion of dust permits easy selection of a time for emptying the dust collecting container.

Sixth, the provision of the primary cyclone unit with two parallel cyclones on one side of an inside of the dust collecting container of a predetermined shape, and the provision of the plurality of secondary cyclones on the other side of the inside of the dust collecting container permits to fabricate the dust collecting device compact, on the whole.

The invention claimed is:

1. A dust collecting device for a vacuum cleaner comprising:

a primary cyclone unit having two parallel primary cyclones for separating dust from air introduced therein by a cyclone principle; and a secondary cyclone unit at a downstream of the primary cyclones for cleaning the air again by the cyclone principle, wherein the dust collecting device further comprising a dust collecting container having the primary cyclones and a primary dust storage portion for storing dust separated by the primary cyclones, wherein the primary cyclone unit is provided to one side of the dust collecting container, and the secondary cyclone unit includes a plurality of secondary cyclones provided to the other side of the dust collecting container, wherein the secondary cyclones are arranged at least in two rows on one side of the dust collecting container.

2. The dust collecting device as claimed in claim 1, wherein the secondary cyclones are arranged in one row along a circumferential direction of the dust collecting container on an inside of the dust collecting container within a predetermined section.

3. The dust collecting device as claimed in claim 1, wherein the primary cyclones are provided in the same size on a front side of the dust collecting container side by side, and the secondary cyclones are provided to a rear side of the dust collecting container.

4. The dust collecting device as claimed in claim 1, wherein the primary cyclone unit further includes a suction guide portion between the primary cyclones for guiding the air containing dust to the primary cyclones.

5. The dust collecting device as claimed in claim 4, wherein the suction guide portion includes a guide surface for guiding the air containing dust to inlets to the primary cyclones.

6. The dust collecting device as claimed in claim 5, wherein the guide surface has one side connected to an edge of the inlet of one of the primary cyclones, the other side connected to an edge of the inlet of the other the primary cyclones, and a middle portion projected toward an inside of the suction guide portion as it goes toward the middle portion from the one side and the other side the more.

7. The dust collecting device as claimed in claim 1, wherein each of the secondary cyclones includes;

a secondary cyclone body having an inlet at a top, and a spiral circulation forming member provided to an inside of the secondary cyclone body for forming a spiral circulation in the secondary cyclone body.

8. The dust collecting device as claimed in claim 7, wherein the spiral circulation forming member includes at least one blade provided to an upper portion of the secondary cyclone body.

9. The dust collecting device as claimed in claim 8, wherein the at least one blade is provided to an outside circumferential surface of an air discharge pipe inserted in an upper portion of the secondary cyclone body for guiding air from the secondary cyclone body.

10. The dust collecting device as claimed in claim 1, wherein the secondary cyclones have axes each formed in an up/down direction, and bottoms each with a dust outlet.

11. The dust collecting device as claimed in claim 10, wherein a secondary dust storage portion is provided under the secondary cyclones on the other side of the dust collecting container separate from the primary dust storage portion for storing dust separated by the secondary cyclone unit.

12. The dust collecting device as claimed in claim 11, wherein the dust collecting container includes an inside dust collecting container on the other side of the dust collecting container to surround the secondary cyclones to form the secondary dust storage portion.

13. The dust collecting device as claimed in claim 12, wherein the dust collecting container has an openable bottom which forms bottoms of the primary dust storage portion and the secondary dust storage portion.

14. The dust collecting device as claimed in claim 11, wherein the dust collecting container has an outside wall formed of a material which can be see-through for enabling to determine dust amounts in the primary dust storage portion and the secondary dust storage portion.

15. The dust collecting device as claimed in claim 1, wherein each of the primary cyclones is provided in the dust collecting container such that an axis thereof lies in an up/down direction, having an inlet in an upper outside circumferential surface, and a bottom end spaced a predetermined distance from a bottom of the primary dust storage portion, and designed to discharge the dust to the primary dust storage portion through the bottom of each of the primary cyclones.

16. The dust collecting device as claimed in claim 15, wherein each of the primary cyclones has a top end connected to an upper cover openably provided on a top of the dust collecting container, and an outside circumferential surface adjacent to an inside wall of the dust collecting container.

17. The dust collecting device as claimed in claim 15, wherein the primary dust storage portion has a bottom area larger than bottom areas of the primary cyclones.

18. The dust collecting device as claimed in claim 15, wherein the dust collecting container further includes a partition wall for dividing the primary dust storage portion into a portion for storing dust separated by one of the primary cyclones, and a portion for storing dust separated by the other one of the primary cyclones.

19. The dust collecting device as claimed in claim 15, wherein the dust collecting container includes a suction pipe for guiding air containing dust to the primary cyclone unit, wherein the suction pipe has an inlet projected from an upper center of an outside circumferential surface of the dust collecting container, and an axis passing through a middle portion of the primary cyclone unit when seen from above the dust collecting container.

20. The dust collecting device as claimed in claim 15, further comprising a hollow air discharge member in each of the primary cyclones, the air discharge member being in communication with the outlet of the primary cyclone and having pass through holes of predetermined sizes in an outside circumferential surface for discharging air.

* * * * *